US005618195A

United States Patent [19]

Cappe

[11] Patent Number: 5,618,195

[45] Date of Patent: Apr. 8, 1997

[54] ELECTRICAL CONNECTOR INCORPORATING CONTACT-LOCKING GRID AND DRAWER

[75] Inventor: Patrice Cappe, Faverolles, France

[73] Assignee: Framatome Connectors International, Courbevoie, France

[21] Appl. No.: 600,209

[22] Filed: Feb. 12, 1996

[30] Foreign Application Priority Data

Feb. 10, 1995 [FR] France ..... 95 01576

[51] Int. Cl.[6] ..... H01R 13/62

[52] U.S. Cl. ..... 439/157

[58] Field of Search ..... 439/152–160, 439/310, 347

[56] References Cited

U.S. PATENT DOCUMENTS

| | | | |
|---|---|---|---|
| 4,586,771 | 5/1986 | Kraemer et al. | 439/157 |
| 5,183,408 | 2/1993 | Hatagishi | 439/157 |
| 5,326,274 | 7/1994 | Pfaff et al. | 439/157 |
| 5,350,313 | 9/1994 | Woller | 439/157 |
| 5,462,447 | 10/1995 | Boiret et al. | 439/157 |
| 5,478,251 | 12/1995 | Jaklin | 439/157 |

FOREIGN PATENT DOCUMENTS

| | | |
|---|---|---|
| 2424643 | 11/1979 | France . |
| 2702889 | 9/1994 | France . |

*Primary Examiner*—Neil Abrams
*Assistant Examiner*—Brian J. Biggi
*Attorney, Agent, or Firm*—Pollock, Vande Sande & Priddy

[57] ABSTRACT

The electrical connector comprises a plug (12) incorporating a housing (22) for receiving electrical contacts and a contact-locking grid (32) designed to be inserted in the plug housing in a direction opposite the direction of insertion until a contact-locking position is reached. It further comprises a mounting base (10) incorporating slots for receiving second electrical contacts, which are parallel to the direction of insertion. A movable drawer in the base has sides incorporating slots having an oblique portion intended for the forced travel of pegs belonging to the plug housing, so that movement of the drawer in one direction causes insertion of the plug in the cavity. The grid comprises a lug designed to constitute a stop for the drawer and to halt insertion of the plug (12) before the pegs (28) engage in the slots (30).

5 Claims, 2 Drawing Sheets

FIG. 1
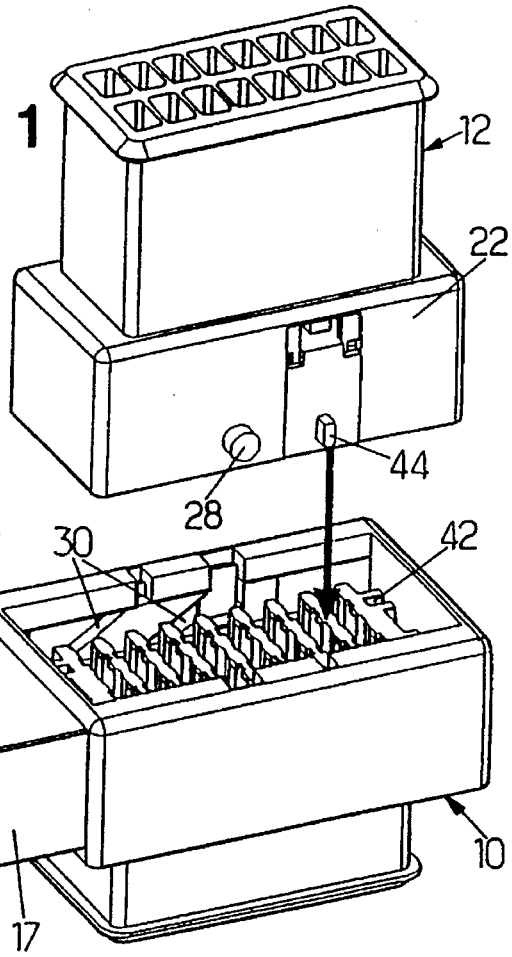
FIG. 3
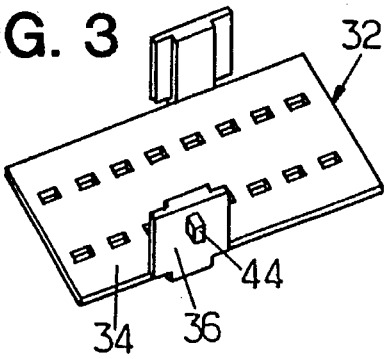
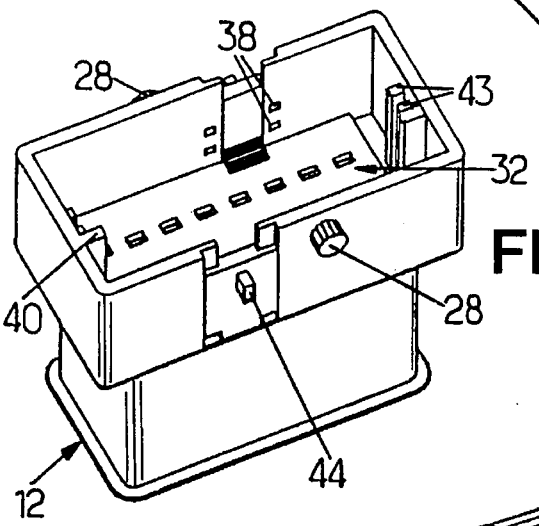
FIG. 2
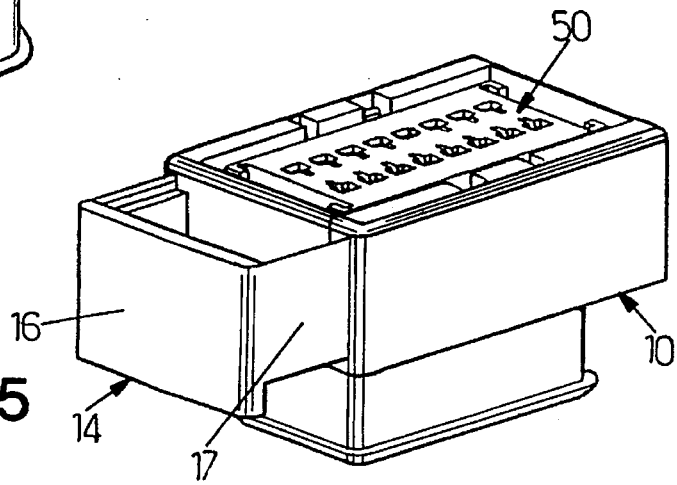
FIG. 5

FIG. 4A
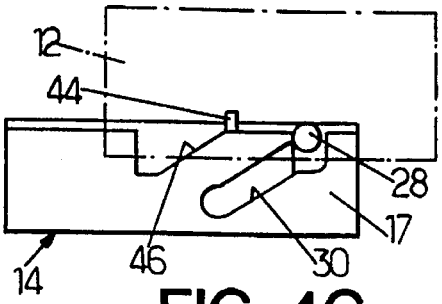
FIG. 4B
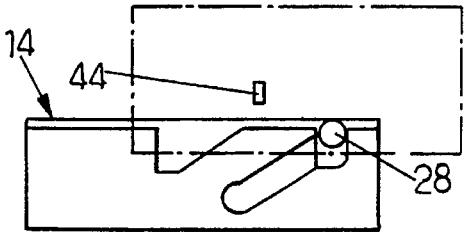
FIG. 4C
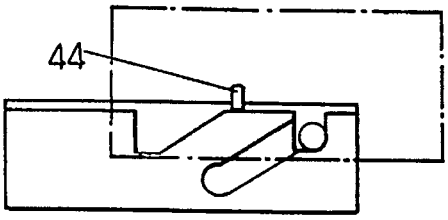
FIG. 4D
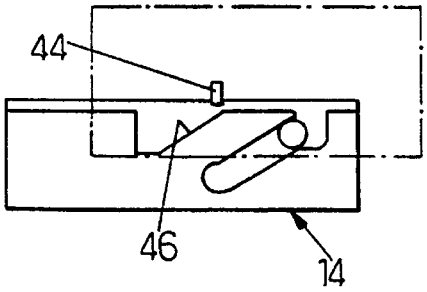
FIG. 4E
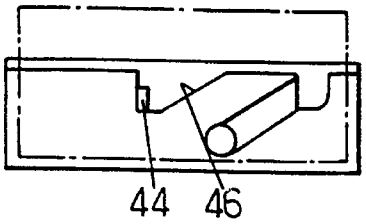
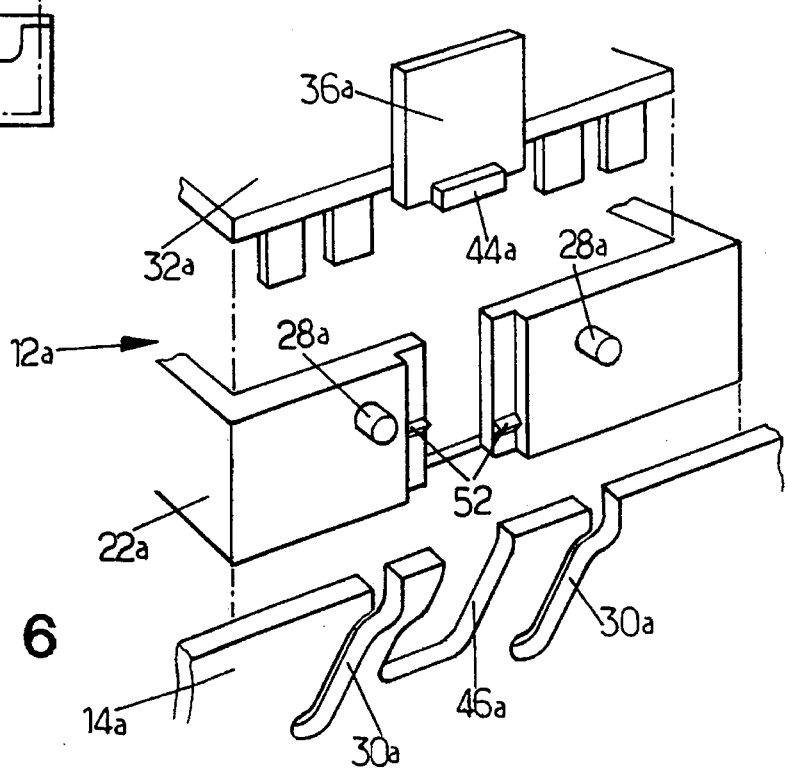
FIG. 6

ELECTRICAL CONNECTOR INCORPORATING CONTACT-LOCKING GRID AND DRAWER

BACKGROUND OF THE INVENTION

The present invention relates to a rectangular electrical connector of the so-called "assisted insertion and removal" type, comprising a plug, a mounting base, and a forced plug-insertion and-removal drawer. Numerous connectors of this type are known, for example that described in Patent No. FR-A-2 424 643.

More precisely, the invention concerns connectors in which the plug is fitted with a grid designed to lock the plug contacts in place when this grid is inserted completely on the plug. Frequent provision of this type of grid allows a pre-locking position, in which the grid remains fastened to the plug while, however, permitting the installation or removal of the contacts. It is important not to plug in the connector as long as the grid does not lock the contacts in place, since it is not completely pushed into place. In fact, in this case the contacts are held in position elastically only. The grid may remain incompletely pushed in, either because of an omission in the pre-locking position, or because its motion has been blocked by a poorly-placed contact.

The invention is intended to remove the risk that the plug and the mounting base will be connected while the grid is not in its completely-inserted position.

SUMMARY OF THE INVENTION

To this end, the invention proposes, in particular, an electric connector comprising:

- a plug having a rectangular housing which incorporates slots parallel to one direction of insertion and designed to receive first electrical contacts, and a grid for locking the first contacts in place and designed to be inserted into the plug housing in the direction opposite to the direction of insertion, until it reaches a position in which the contacts are locked in place in the plug,
- a mounting base having a housing and incorporating slots for receiving second electrical contacts parallel to the direction of insertion, said mounting base delimiting a cavity for housing the plug, and
- a drawer movable in the mounting base transversely to the direction of insertion, whose sides incorporate slots comprising an oblique portion designed for the forced movement of pegs integral with the plug housing, so that the movement of the drawer in one direction causes the plug to be pushed into the cavity, and, in the other direction, causes disconnection of the plug;
- wherein the grid comprises at least one lug designed to constitute a stop for the drawer and to halt insertion of the plug before the pegs are inserted in the slots when the grid is incompletely pushed in.

The side, or each side, of the clamp may comprise a cut-out portion allowing passage of the lug when the drawer is fully inserted and incorporating a lug-sliding edge parallel to the oblique portion of the inclined surface.

In general, each side of the drawer carries a lug. Especially when the cut-out portion incorporates a guide edge, it is sufficient that each side comprise a single slot designed to receive a corresponding peg. In one advantageous embodiment, the two pegs are arranged along one diagonal of a virtual rectangle, and the two lugs, along the other diagonal.

To permit ease of insertion of the pegs in the slots, the latter advantageously possess an entry zone parallel to the direction of insertion. Beyond the oblique portion constituting a ramp, the slots may comprise an end part substantially parallel to the direction of travel of the drawer, and thus perpendicular to the direction of insertion, thereby preventing vibrations from tending to detach the plug from the mounting base while pushing out the drawer.

BRIEF DESCRIPTION OF THE DRAWINGS

Still other features of the invention will become manifest from a reading of the following description of a specific embodiment provided by virtue of example. The description makes reference to the drawings accompanying it, in which:

FIG. 1 is a perspective view of the detached connector, when the drawer is in the stand-by position and the plug grid is in the pre-locking position;

FIG. 2 is a perspective view of the plug, whose position is reversed in relation to that in FIG. 2 (sic), while the grid is in the locked position;

FIG. 3 is a diagram in perspective intended to illustrate the overall appearance of the grid belonging to the plug;

FIGS. 4A to 4E are raised diagrams illustrating the positioning of the drawer and of the plug, respectively, during the different phases of insertion.

FIG. 5, which is similar to a portion of FIG. 1, represents the mounting base fitted with a grid; and FIG. 6 is an exploded perspective view illustrating part of the plug, the drawer, and the grid of a connector, according to a variant.

DETAILED DESCRIPTION

The connector illustrated in FIG. 1 comprises a mounting base 10 and a plug 12. The terms "plug" and "base" are employed for the sake of convenience, and do not suggest that the base constitutes the stationary component of the connector. The base incorporates a clamp-shaped drawer 14 intended for insertion and removal and comprising an end piece 16 and two sides 17.

The base 10 comprises a housing having an elongated rectangular section. Two slots are cut in one of the short sides. They allow insertion of the sides 17 of the drawer 14, which slides against the internal faces of the long sides and is guided by an internal edge incorporated into the long sides. Accordingly, the drawer 14 may be moved in the direction F, but is held in the direction of insertion and removal, which is orthogonal to F.

The plug 12 also comprises a housing 22 having a rectangular section. Most of the external face thereof is smooth. The front part of the plug is arranged so as to slide into a cavity in the base, by sliding against the short sides and against the internal edges in the base housing which guide the drawer.

The drawer 14 and the plug 12 comprise cooperating means designed, in response to the travel of the drawer 14 in the direction of the arrow F, to cause insertion and locking of the plug and to cause removal of the plug by moving the drawer in the opposite direction.

The means equipping the plug include pegs 28 projecting outward from the large surfaces of the housing. In the embodiment illustrated, two pegs are provided, one on each side. They are reciprocally offset in the direction of the arrow F and are equidistant from the middle of the large surfaces. These pegs 28 are designed to be inserted in the slots 30 produced in the sides of the drawer 14 and opening along the edge of the sides facing the plug 12.

In the embodiment shown in FIGS. 4A–4E, the slots 30 possess a composite shape. The entry thereof is parallel to the direction of insertion. The slots then incorporate an oblique portion designed to constitute a cam ramp. Finally, an end section of the slots is advantageously parallel to the direction F.

In addition to its housing 22, the plug 12 comprises a contact-locking grid 32. The grid illustrated in FIGS. 1, 2, and 3 is made in a single piece. It may be considered to have a bottom 34 incorporating holes for the passage of the electrical contacts belonging to the plug and two plates 36 parallel to the direction of insertion, which have a T-shaped section enabling them to slide in the slide-track slots produced in the long sides of the housing 22. Lugs, or catches (not shown in FIGS. 1–5), are provided on the plates and are designed to fit in holes 38 in the long sides. These holes are positioned so as to hold the grid 32 elastically either in the pre-locking position as illustrated in FIG. 1 or in the full contact-locking position shown in FIG. 2.

To prevent the plug from being connected in a reversed position, so-called "polarization" means are normally provided. In the case illustrated in FIG. 2 these means comprise one or two internal ribs 40 belonging to the housing 22, which are designed to fit into the slots 42 in the base housing. They may be supplemented by coding ribs 43.

The connector according to the invention comprises means intended to prevent connection when the grid 32 is not completely inserted. The means shown in FIGS. 1 to 4 comprise two lugs 44. In the embodiment shown, the two lugs 44 and the two pegs 28 are arranged along the two diagonals of a rectangle, and not by opposite pairs. An indentation 46 is cut in each side 17 of the drawer 14 (FIGS. 4A–4E), this indentation being positioned in such a way that it is not yet opposite the lug 44 when the pegs 28 are opposite the entries to the slots 30. When the grid 32 is only partially inserted, that is, in the position shown in FIG. 1, the lugs come into contact with the edge of the drawer before the pegs 28 have engaged in the oblique portion of the slots (FIG. 4A). If, to the contrary, the grid 32 is completely inserted, the lugs 44 are still at a distance from the edge of the drawer 14 when the pegs 28 engage in the slots (FIG. 4B and 4C). The movement of the drawer and the insertion of the plug into the base 10 may continue (FIG. 4B). When the lug 44 reaches a position inside the drawer 14, it is opposite the indentation 46. It is only at the end of the drawer-insertion operation (FIG. 4A) that the lug 44 is stopped, once again, against the bottom and the end surface of the indentation 46.

If the grid remains in the pre-locking position inadvertently, and not as the result of jamming caused by a poorly-inserted contact, the pressure exerted by the slot can, in most instances, complete the insertion process.

In an advantageous embodiment illustrated in FIG. 4A, the notch, or indentation, 46 has an edge parallel to the oblique portion of the slot 44. The lug can slide on this edge and help guide the plug as it is being in inserted.

The base 10 may also comprise a grid 50 (FIG. 5) designed to lock in place the contacts belonging to the base.

The invention can be adapted to numerous variants. In the case illustrated in FIG. 6, in which the components corresponding to those previously illustrated in FIGS. 1–5 bear the same reference numbers, to which the letter a is added, the housing 22*a* of the plug 12*a* comprises two pegs 28*a* on each side. These pegs are intended to be inserted in corresponding slots 30*a* in the drawer 14*a*. The grid 32*a* also incorporates a lug 44*a* which cooperates with a notch 46*a* in the drawer. The notch illustrated possesses a more complex shape than in FIGS. 4A–4E, thereby leaving a finger between the notch and the closest wall of one of the slots 30*a*. The slide-tracks receiving the plates 36*a* may comprise catches 52, one designed to secure the pre-locking position, and the other, the fully-locked position of the grid 32*a*.

What is claimed is:

1. Electrical connector comprising:

(a) a plug (12) having a housing (22) incorporating slots parallel to one direction of insertion and designed to receive first electrical contacts, and a contact-locking grid (32) designed to be inserted in the plug housing in a direction opposite to the direction of insertion until a contact-locking position is reached;

(b) a mounting base (10) having a housing comprising slots for receiving second electrical contacts which are parallel to the direction of insertion, said mounting base delimiting a plug-reception cavity; and (c) a drawer movable in the base transversely to the direction of insertion and comprising sides incorporating slots having an oblique portion for the forced travel of pegs belonging to the plug housing, so that the movement of the drawer in one direction causes insertion of the plug in the cavity, and, in the other direction, removal of the plug;

(d) wherein the grid comprises at least one lug designed to form a stop for the drawer and to block insertion of the plug (12) prior to the engagement of the pegs (28) in the slots (30) when the grid is not completely inserted.

2. Connector according to claim 1, wherein the side, or each side, (17) of the drawer (14) incorporates an indentation (46) housing the corresponding lug (44).

3. Connector according to claim 2, wherein each indentation incorporates a lug (44)-sliding edge parallel to the oblique portion of the slot, which forms a ramp.

4. Connector according to claim 1, wherein each of the two long sides of the housing (22) of the plug (12) carries a single peg (28) and the two pegs are positioned along a diagonal of a rectangle, the two lugs (44) being arranged along the other diagonal.

5. Connector according to claim 4, wherein the grid (32) comprises a bottom (34) containing holes for the insertion of contacts belonging to the plug and two plates (36) carrying the lugs, which are designed to slide in slots forming slide-tracks in the plug housing (22) and fitted with means (52) for elastic position-retention in a locking and a pre-locking position.

* * * * *